United States Patent [19]

Urani

[11] Patent Number: 4,477,139

[45] Date of Patent: Oct. 16, 1984

[54] SHOCK PROOF FUSEHOLDER

[75] Inventor: Angelo Urani, St. Louis, Mo.

[73] Assignee: McGraw-Edison Company, Rolling Meadows, Ill.

[21] Appl. No.: 397,679

[22] Filed: Jul. 12, 1982

[51] Int. Cl.[3] ..... H01R 19/24

[52] U.S. Cl. ..... 339/88 R; 339/130 C; 339/147 R

[58] Field of Search ..... 339/88 R, 130 R, 130 C, 339/147 R, 147 P, 188 R, 188 C, 189 R, 190, 252 F, 262 F; 337/201

[56] References Cited

U.S. PATENT DOCUMENTS

| | | | |
|---|---|---|---|
| 3,177,318 | 4/1965 | Lebens | 200/129 |
| 3,236,974 | 2/1966 | Louden et al. | 337/201 |
| 3,268,693 | 8/1966 | Linton | 337/201 |
| 3,659,252 | 4/1972 | Brown | 337/201 |
| 3,828,291 | 8/1974 | Urani | 337/201 |

FOREIGN PATENT DOCUMENTS

| | | | |
|---|---|---|---|
| 1934868 | 12/1970 | Fed. Rep. of Germany | 337/201 |
| 2221710 | 11/1972 | Fed. Rep. of Germany | 337/201 |
| 442494 | 1/1968 | Switzerland | 337/201 |

*Primary Examiner*—John McQuade

*Attorney, Agent, or Firm*—Charles W. MacKinnon; Jon Carl Gealow

[57] ABSTRACT

A panel mounted fuseholder has a cylindrical base and a head which fits into and locks unto the base by a shock proof, bayonet connection. The base has a rear terminal and a cylindrical side terminal for connection of the fuseholder in series with the circuit to be protected. The head has an insulative endcap and a conductive bayonet insert. A pair of "U" shaped fingers extend from one edge of the cylindrical side terminal to form the base side of the bayonet connection. The head side is formed by a pair "J" shaped arms which extend from one end of the bayonet insert. Protrusions extend from the interior surface of the bight of the "U" shaped fingers. The protrusions are dimensioned to make continuous contact with the outside surface of the "J" shaped arms when the arms are inserted within the fingers to thereby prevent loss of power to the protected circuit.

6 Claims, 5 Drawing Figures

SHOCK PROOF FUSEHOLDER

BACKGROUND OF THE INVENTION

This invention generally relates to a holder for electrical fuses and more particularly to a fuseholder which may be panel mounted with electrical connections thereto being made behind the panel.

Examples of such a panel mounted fuseholders are shown in U.S. Pat. Nos. 3,828,291 and 3,177,318, which are assigned to the same assignee as the present invention. Typically, such a panel mounted fuseholders include a base and a detachable head adapted for joinder. The most common fuses for use with these fuseholders are miniature, cylindrical, glass type fuses having conductive end caps or ferrules. One end of such fuse is ordinarily inserted a fraction of its length into a conductive cylindrical chamber within the head of the fuseholder and is generally held there by a leaf spring or friction fit. The fuse and head assembly is then inserted into the base where the second or bottom end cap or ferrule of the fuse makes electrical contact with a rear terminal of the base of the fuseholder.

Normally, an extended portion of the conductive chamber of the head of the fuseholder protrudes into the base where it makes electrical contact by a bayonet or friction connection with a side terminal piece. The head, commonly, includes a helical compression spring within the conductive cylindrical chamber to press the fuse into good electrical contact with the rear terminal and to bias the head away from the base to ensure a good electrical connection at the bayonet between the conductive head chamber and the side terminal. However, conventional bayonet connections will only make reliable electrical contact when the bias between the head and base is sufficiently maintained. Any outside pressure on the head or jarring or vibration of the fuseholder is likely to cause the connections to open. This opening may be produced by accidental or deliberate pushing of the head or may occur because of vibration or the like produced in the environment in which the fuseholder is used, such as, for example, in moving vehicles or in areas where physical contact or natural occurrences cause instability. Opening of these contacts causes a power loss to circuit units protected by the fuse. This could in turn cause holding contacts to drop out, units to shut down, loss of vulnerable memory, long restart or warm-up times, and even unit damage due to voltage and current transients.

SUMMARY OF THE INVENTION

It is therefore an object of this invention to provide a new and improved fuseholder which overcomes the disadvantages and drawbacks of prior art fuseholders described heretofore and which minimizes or virtually eliminates disconnection due to outside pressure on the head, vibration or jarring.

It is another object of this invention to provide a fuseholder of the last-mentioned type in which a fuse may be easily installed and removed and which is readily serviceable.

It is still another object of this invention to provide a new and improved, low-cost fuseholder of relatively simple construction, which can be readily and economically assembled with a minimum effort and skill.

The foregoing objects are accomplished in accordance with this invention in one form thereof, by providing a fuseholder having a cylindrical threaded base which may be mounted through a hole defined in a panel and a head which fits into and locks onto the base by a shockproof, bayonet connection.

The base includes a rear terminal and a cylindrical side terminal, for connection of the fuseholder in series with the circuit to be protected. The head includes an insulative endcap and a conductive bayonet insert. One end of the insert includes a compression spring and a holding spring each of which are electrically connected to one ferrule of the fuse. The other end of the insert forms the head side of the bayonet connection with the side terminal within the base. The opposite fuse ferrule makes electrical connection to the rear terminal in the base.

A pair of "U" shaped fingers extend from one edge of the cylindrical side terminal to form the base side of the bayonet connection. The head side is formed by a pair of "J" shaped arms which extend from the connection end of the bayonet insert. When assembled, electrical connection between the insert and the side terminal is made between the "J" shaped arms and the "U" shaped fingers. The contact is normally held together by the force of the compression spring, which applies force against the base through the fuse on one side and against the head on the other side. The spring thereby acts to urge the base and head apart while the bayonet contact holds them together.

If vibration, jarring or inadvertent pressure on the head occurs, it is still possible that the spring loaded connection might be broken, causing a power loss to the protected circuit. Therefore, nipples or protuberances which extend from the interior surface of the bight of the "U" shaped fingers are included. The nipples are dimensioned to make continuous contact with the outside surface of the "J" shaped arms when the arms are inserted within the fingers. The nipples effectively prevent any power loss to the protected circuit caused by physical contact with or jarring of the fuseholder. Further, a good electrical connection is maintained even if the head is turned relative to the base until the arms are substantially removed from the fingers during deliberate extraction of the head and fuse from the base.

DETAILED DESCRIPTION OF PREFERRED EMBODIMENT

Figure 1:
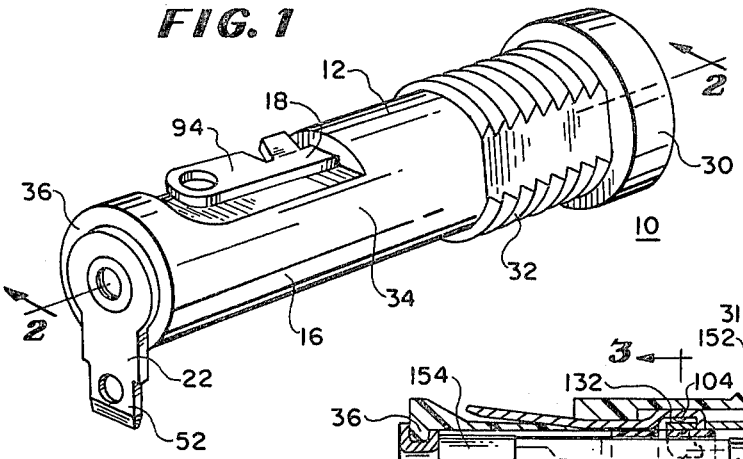
FIG. 1 is a perspective view of a new and improved fuseholder according to the invention.
Figure 3:
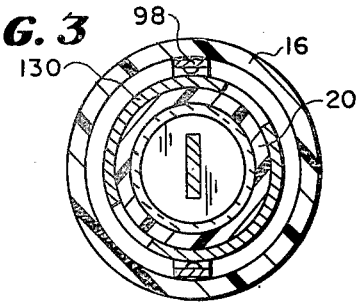
FIG. 3 is a cross-sectional view of the fuseholder of FIG. 2 taken along line 3—3.
Figure 4:
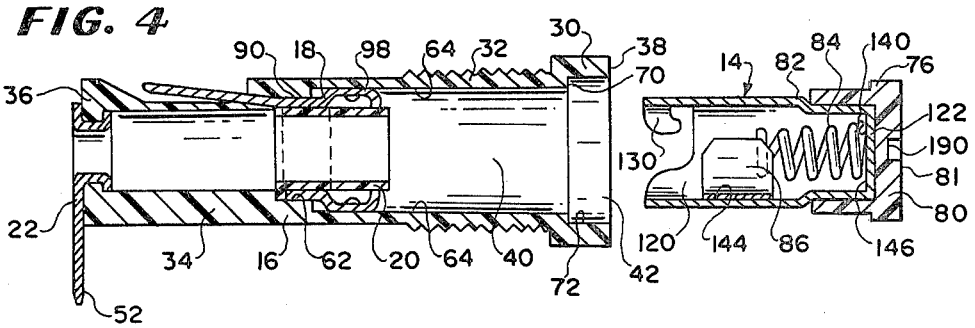
FIG. 4 is a cross-sectional view of a fuseholder according to the invention shown in a disassembled condition with the fuse removed.

Referring now to the drawings in greater detail, a shockproof fuseholder 10 according to the invention comprises easily separable base and head portions 12 and 14, respectively. As seen in FIGS. 1 and 4, base 12 includes a threaded, cylindrical body 16, a side terminal 18, an insulative spacer 20 and a rear eyelet shaped terminal 22. Cylindrical body 16 is preferably formed of insulative material, such as plastic or bakelite. Body 16 includes a flange portion 30 formed at a first open end 42, an adjacent externally threaded portion 32, an elongated stem portion 34 adjacent threaded portion 32 and partially closed, second end 36. Body 16 of base 12 is generally hollow and defines a cavity 40 having decreasing interior diametrical demensions defining ridges therealong. Partially closed second end 36 is dimensioned to accept rear eyelet shaped terminal 22 in a conventional manner. A tab 52 extends from rear eyelet terminal 22 for making an external electrical connection thereto.

Figure 5:
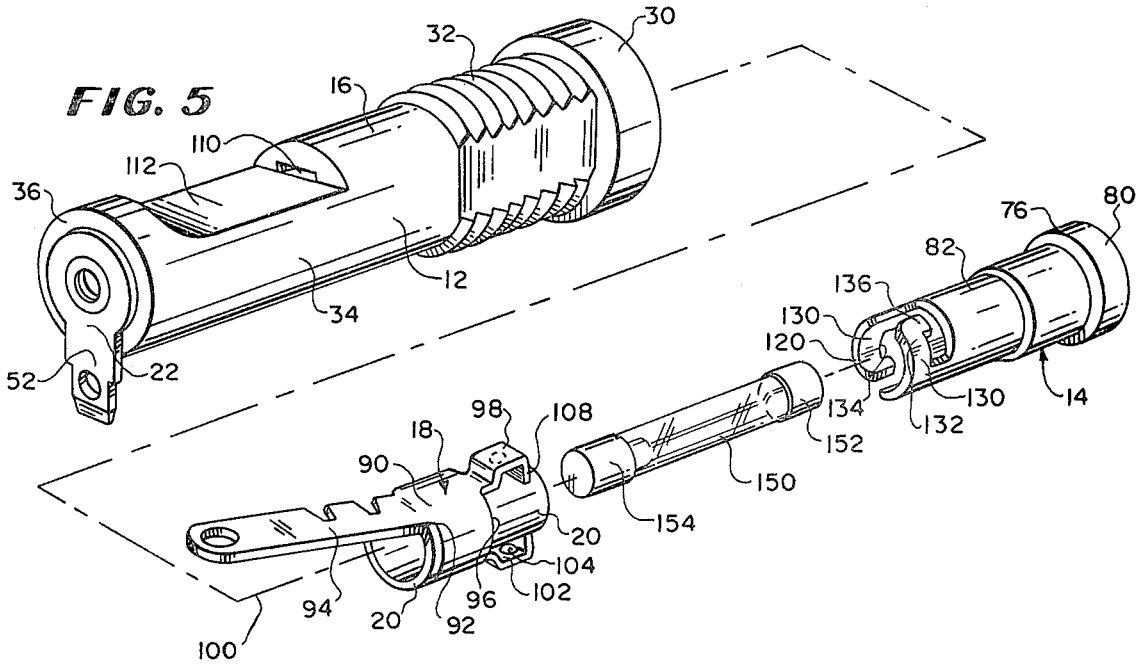
FIG. 5 is an exploded perspective view of the fuseholder and fuse of FIG. 1.

A first interior cylindrical wall 62, a second ridge 60, and a second interior cylindrical wall 64 are dimensioned to hold side terminal 18 and spacer 20, securely within cavity 40 of body 16. Side terminal 18, as best seen in FIG. 5, is electrically conductive and includes a main hollow cylindrical portion 90. From a first edge 92 of cylindrical portion 90 there extends an elongated flat connector tab 94. A pair of "U" shaped fingers 98 are spaced 180° about cylindrical portion 90 and extend from the second edge 96 of the cylindrical portion 90. "U" shaped fingers 98 open in the direction of central-axis line 100 of cylindrical portion 90 as seen in FIGS. 4 and 5. Protuberances or nipples 104 are defined on the interior surface 102 of the bight of the "U" shaped fingers 98. Nipples 104 extend radially inwardly in the direction of the legs of the U toward insulative spacer 20 to define a predetermined gap therebetween.

Insulative spacer 20 is hollow, cylindrical in shape and is sized to fit securely within the main hollow cylindrical portion 90 of side terminal 18 and to extend past second edge 96 of portion 90 and come in contact with and also extend slightly beyond "U" shaped fingers 98.

When base 12 is assembled, electrical connector tab 94 protrudes through a central side aperature 110 located in body 16. Body 16 includes a flat depression 112 which facilitates simple insertion of connector tab 94 through aperture 110 and allows for easy electrical wiring to tab 94 in relatively limited spaces.

Head 14 is dimensioned to be received within cavity 40 of base 12 when fuseholder 10 is assembled. As best seen in FIGS. 4 and 5, head 14 includes an insulative end cap 80, a conductive bayonet insert 82, a compression spring 84, and a fuseholding spring 86. The bayonet insert 82 is hollow, cylindrical in shape, open at a first end 120 and closed off at its second end 122. Insulative end cap 80 which is received over closed end 122 of head 14, includes a flange 76. A ridge 70 within cavity 40 of base 12 limits the insertion of head 14 into base 40. End cap 80 when received in cavity 40, is positioned concentrically within interior wall 72 of body 16.

Fuseholder spring 86 is a semi-cylindrical leaf spring which is attached to the interior wall 144 of bayonet insert 82 adjacent to first open end 120. Leaf spring 86 is dimensioned to loosely hold first end ferrule 152 of a fuse 150. Compression spring 84 is a helical spring, attached at its first end 140 to the inside surface 146 of closed off end 122 of bayonet insert 82.

First open end 120 of bayonet insert 82 defines a pair of "J" shaped arms 130 spaced 180° about insert 82, which arms are contoured to define a central axis, coincident with the central-axis line 100 and are dimensioned to be received by U-shaped fingers 98 of side terminal 18 when head 14 is inserted into base 12 and rotated clockwise with respect to base 12.

Figure 2:
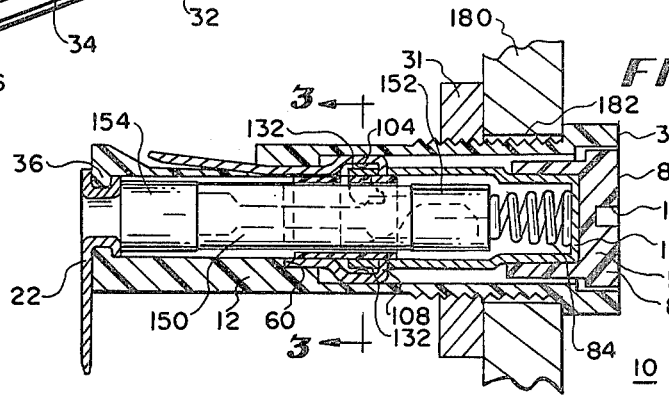
FIG. 2 is a cross-sectional view of the fuseholder of FIG. 1, including a glass cylindrical fuse, taken along line 2—2.

Fuseholder 10 is normally secured to a panel 180, as seen in FIG. 2, by tightening a nut 31 onto threaded portion 32 of body 16 after the elongated stem portion of the body has been passed through an aperture 182 in panel 180, effectively clamping the panel between nut 31 and flange 30 of body 16.

When fuseholder 10 is fully assembled including a fuse 150, as seen in FIG. 2, face 81 of end cap 80 on head 14 is flush with face 38 of flange 30. In addition, spring 84 is compressed between the first end ferrule 152 of fuse 150 and closed off end 122 of bayonet insert 82. Fuse 150 thereby is pressed into good electrical contact at its second end ferrule 154 with rear terminal 22. To hold spring 84 in compression between bayonet insert 82 and fuse 150, "J" shaped arms 130 of insert 82 are held by "U" shaped fingers 98 of side terminal 18, secured to base 12.

Electrical connection between first end ferrule 152 of fuse 150 and side terminal 18 is made through fuseholding leaf spring 86 and compression spring 84 to bayonet insert 82. The top edge 134 of "J" shaped arms 130 are held in good electrical contact with top portion 108 of "U" shaped fingers 98 by pressure exerted by compression spring 84 on bayonet insert 82 and on base 12 through fuse 150. However, because the electrical connection between "J" shaped arms 130 of bayonet insert 82 and "U" shaped fingers 98 of side terminal 18 may become opened during vibration or jarring or if head 14 is inadvertently pressed, nipples or protuberances 104 which extend from the bight of "U" shaped fingers 98 are positioned to make continuous contact with the outside surfaces 132 of arms 130 whenever any portion of arms 130 are inserted within fingers 98.

Removal of an open fuse is performed most easily with the use of a standard screwdriver although removal is possible with the use of a coin or by hand. Removal is accomplished by inserting the screwdriver blade or other flat instrument into slot 190 on head 14, depressing the head slightly into base 12 and turning the head approximately one-quarter turn counter-clockwise while keeping it depressed. This allows the upturned tip 136 of arms 130 to move unobstructed within fingers 98. If head 14 is not depressed while turning, upturned tip 136 will catch on the top portion 108 of fingers 98 thereby preventing further turning and removal. After head 14 has been depressed and turned, it may be released, allowing the force of compression spring 84 to push head 14 partially out of base 12. Head 14 and fuse 150, which is loosely held in head 14 by fuseholder leaf spring 86 may then be easily removed from base 12. Fuse 150 may then be extracted from the hold of fuseholder leaf spring 86 and replaced if necessary. The above-described procedure is reversed to replace head 14 and fuse 150 into base 12.

While a particular embodiment of the invention has been shown and described, it should be understood that the invention is not limited thereto since many modifications may be made. It is therefore contemplated to cover by the present application any and all such modifications as fall within the true spirit and scope of the appended claims.

What is claimed is as follows:

1. A holder for an electric fuse comprising a hollow cylindrical base and a hollow cylindrical head, said head dimensioned for receipt in said base, said base including a side terminal and a rear terminal, said side terminal having at least one "U" shaped finger opening in the direction of the central axis of said cylindrical base, said finger including a protuberance extending from the bight of said "U" shaped finger in the direction of the legs of the U into the interior of said finger, said head including a conductive bayonet insert, said bayonet insert including at least one "J" shaped arm which is contoured to lie within a cylindrical arc, said cylindrical arc having a central axis coincident with said central axis of said cylindrical base, said "J" shaped arm being dimensioned to be received within said "U" shaped finger when said head is inserted into said base and rotated, said protuberance being positioned to make continuous electrical contact with said arm when said arm is received within said finger.

2. The holder for an electrical fuse as recited in claim 1 wherein said side terminal includes a plurality of "U" shaped fingers and said bayonet insert includes a plurality of "J" shaped arms, each of said arms being contoured to lie within said cylindrical arc, said arc having a central axis coincident with the central axis of said cylindrical base and dimensioned to be received within said fingers.

3. The holder for an electrical fuse as recited in claim 1, wherein said hollow cylindrical base includes an open first end, a partially closed second end, and a central side aperture, said rear terminal protruding through said partially closed second end, and said side terminal protruding through said central side aperture such that electrical connection to said holder is relatively easily accomplished.

4. The holder for an electrical fuse as recited in claim 3, wherein said fuse includes a cylindrical body having first and second end ferrules, said conductive bayonet insert includes an open first end, closed second end and a cylindrical interior side wall, said head further including a compression spring and fuse holder spring said compression spring being attached at a first end at said closed second end of and within said conductive bayonet insert, said compression spring contacting said first end ferrule of said fuse at said compression springs second end, said fuse holder spring being positioned within said conductive bayonet insert for loosely holding and making good electrical contact with said first end ferrule of said fuse, said second end ferrule of said fuse making good electrical contact with said rear terminal, thereby completing a series circuit between said side terminal and said rear terminal when said fuse is held within said assembled holder.

5. The holder for an electric fuse as recited in claim 4, wherein said compression spring biases said head away from said base when said fuse is received within said holder, said "J" shaped arm being locked within said "U" shaped finger in response to the biasing of said head and base away from each other.

6. The holder for an electric fuse as recited in claim 3, wherein said base includes a nut, a flange and a threaded exterior portion adjacent said open first end whereby said base is mountable on a panel said panel defining an aperture for receipt of said base said nut being receivable on said threaded portion of said body such that when mounted said body extends substantially behind said panel and said panel is held between said nut and said flange.

* * * * *